US005247297A

United States Patent [19]

Seabury et al.

[11] Patent Number: 5,247,297

[45] Date of Patent: Sep. 21, 1993

[54] VEHICLE DETECTOR METHOD FOR MULTIPLE VEHICLE COUNTING

[75] Inventors: Thomas W. Seabury, Diablo; Robert S. Allen, Livermore, both of Calif.

[73] Assignee: Detector Systems, Inc., Stanton, Calif.

[21] Appl. No.: 811,767

[22] Filed: Dec. 20, 1991

[51] Int. Cl.[5] ..... G08G 1/01; G06M 1/00

[52] U.S. Cl. ..... 340/941; 340/933; 340/934; 377/9; 235/99 A

[58] Field of Search ..... 340/941, 933, 934; 377/9, 19, 12; 235/99 A

[56] References Cited

U.S. PATENT DOCUMENTS

| | | | |
|---|---|---|---|
| 3,943,339 | 3/1976 | Koerner et al. | 340/941 |
| 4,201,908 | 5/1980 | Johnson et al. | 340/941 |
| 4,296,401 | 10/1981 | Duley | 340/941 |
| 4,491,841 | 1/1985 | Clark | 340/941 |
| 5,028,921 | 7/1991 | Potter | 340/941 |

*Primary Examiner*—Donnie L. Crosland
*Attorney, Agent, or Firm*—Townsend and Townsend Khourie and Crew

[57] ABSTRACT

An estimate of the number of vehicles crossing a loop inductor having one or more interconnected discrete loops of the type found in vehicle detector system installations. A measuring signal follows changes in loop inductance caused by the influence of vehicles crossing the loop inductor. A vehicle count threshold value is computed by observing changes in the measuring signal caused by the first car crossing the loop. Subsequent excursions of the measuring signal between relative minima and relative maxima are tested against the threshold and a vehicle count event is registered when the differences exceed the threshold. After a predetermined count period, the number of vehicle counts is estimated from the total count events by multiplying them by an interpolation factor determined empirically from the type of loop inductor. Apparatus for perfoming the method is combined with a conventional vehicle detector system in a switch selectable apparatus for specifying vehicle detector mode or vehicle count mode. The system furhter includes a user selectable circuit for matching the interpolation factor to the type of loop inductor used with the system.

19 Claims, 5 Drawing Sheets

VEHICLE DETECTOR METHOD FOR MULTIPLE VEHICLE COUNTING

BACKGROUND OF THE INVENTION

This invention relates to the field of vehicle counting. More specifically, this invention relates to techniques for counting moving vehicles.

The need to provide an accurate count of the number of vehicles passing by a selected location has existed for a substantial period of time. Vehicle count information is used for a number of purposes, such as determining the total volume of vehicular traffic through a particular intersection or past a given location of a highway. In the past, vehicle counting has been effected in a number of ways. Perhaps the most popular way has been to hire an individual to stand at the particular location and actually count the number of vehicles observed by that individual passing by the particular location. This method suffers from the disadvantage that the total count obtained, particularly over a relatively long period of time, can be highly inaccurate, depending on the dedication and concentration powers of the individual. Further, the individual is frequently exposed to physical danger due that person's presence at the counting site. Another technique used in the past for counting vehicles employs a road tube placed across one or more lanes of the highway and connected to a compatible counting mechanism. This arrangement suffers from the disadvantage that the road tube is This arrangement suffers from the disadvantage that the road tube is susceptible to physical wear caused by the passage of the vehicle wheels over the tube and direct damage from snow removal equipment, and is also subject to deterioration caused by environmental exposure over severe temperature ranges. In addition, such devices are typically electrically powered, which requires either a permanent or portable source of electrical power which must be reliable over the counting period. In addition, such equipment is prone to tampering and/or theft and can be difficult to install in certain locations. In addition, the road tube counting mechanisms may be expensive to purchase and repair.

Vehicle detector systems have been used for a substantial period of time to generate information specifying the presence or absence of a vehicle at a particular location. Such detectors have been used at intersections, for example, to supply information used to control the operation of the traffic signal heads and have also been used to supply control information used in conjunction with automatic entrance and exit gates in parking lots, garages and buildings. Since the purpose for which vehicle detector systems have been developed requires only the determination of whether a vehicle of a particular class (i.e., size or weight) is present or absent, such systems are not directly suitable for use in counting the total number of vehicles passing by a specified location. For example, in an application for a controlled intersection having a left turn green arrow lane, the green arrow may be controlled in such a manner that activation is only done when a vehicle is actually present in the left turn lane. Such presence is indicated by a change in inductance of a closed loop circuit driven by an oscillator in the vehicle detector system, the inductance decreasing from a reference value when a vehicle enters the loop (or is in close proximity to the loop). So long as this changed level of inductance remains, the left turn lane vehicle detector will signal the presence of a vehicle in that lane by generating a signal termed a Call Signal. When the green arrow is activated by the traffic control system, the vehicle originally present in the loop and waiting for permission to enter the intersection leaves the loop. If this were the only vehicle in the loop, then the inductance changes back to a value close to the reference value and the traffic control unit is then free to time out the permissive green signal. If more than one vehicle was originally present in the left turn lane and thus affecting the inductance of the loop circuit, the vehicle detector will simply continue to register the call signal until the last vehicle has left the loop (or until the system has reached a maximum time out limit). As a consequence of this design, vehicle detector systems have not been capable, as originally designed, of providing an accurate count of the total number of vehicles crossing the loop. Since a large number of vehicle detectors are already installed in highways, and since the vehicle detector system technology in general has reached a relatively high degree of sophistication, it would be most beneficial if such systems could be adapted to provide a vehicle counting function without expensive additions to the raodway loop system.

SUMMARY OF THE INVENTION

The invention comprises a method and system for enabling a vehicle detector system of the variable inductance type to provide accurate vehicle count information.

In a first aspect, the invention comprises a method for providing a vehicle count which employs a unique algorithm based on empirically obtained data. More specifically, the method proceeds by obtaining an initial reference value representative of the inductance of a loop oscillator circuit in a vehicle detector system with no vehicle present. Once the initial reference value has been obtained, the inductance of the loop circuit is regularly monitored, preferably in a periodic fashion, and changes in the reference value are noted and compared with the initial value. When the inductance value changes by a predetermined threshold amount, normally used to signify the presence of a vehicle in the loop, successive changes in the reference value are monitored until the direction of change reverses. When this occurs, the absolute difference between the peak value and the initial value is obtained, and a selected percentage of this difference is used to monitor the future behavior of the inductance. In addition, the changes in the regular sample values are successively monitored for another reversal in direction. When such a reversal is observed, the sample value is noted and successive changes in the value are compared with this minimum value. If the value of the difference between a present sample and this last relative minimum value exceeds the calculated reference threshold, this event is determined to be a count event. If the direction of change reverses before the threshold is exceeded, a new relative minimum value is determined and the comparative process continues. Each time a present sample exceeds the current relative minimum value by the threshold amount, another count event is noted. Once the sample value returns to the orginal value (or a value close to the original value), signifying that all vehicles have left the loop, the number of count events are summed and interpreted in accordance with the nature of the loop. If the loop is a single loop, the total number of count events are set equal to the number of vehicles passing through the loop during the previous counting cycle period. If the number of loops is greater than one, then the count events are interpolated in accordance with an interpolation table originally obtained empirically to provide a true vehicle count. In this latter case, the count is always less than the total number of count events.

In another aspect, the invention comprises a vehicle detector system in which the conventional vehicle call information is used to generate the vehicle count events noted above by means for providing an initial reference sample representative of the inductance of an empty loop, means for providing successive samples representative of vehicle inductance, means for comparing each successive sample with the initial sample reference value, means for observing a reversal in the value changes of successive samples and selecting the previous value as a relative maximum, means for observing a successive reversal in direction of the sample values and denoting a relative minimum value, means for comparing successive samples with the relative minimum value and generating a count event when the difference exceeds a threshold, and means for continuing this process until the current sample indicates the departure of all vehicles from the loop. The system further includes means for computing the actual vehicle count from the total number of count events generated during the vehicle counting cycle.

The invention provides the vehicle counting function to an accuracy as great as that employed in prior techniques. In those locations in which a vehicle detector system is already present, the vehicle counting function can be performed by modifying the operation of an existing vehicle detector system, thereby adding only relatively low additional cost for the equipment. For those intersections or other locations not having an existing vehicle detector system, the invention permits the vehicle counting function to be provided along with the conventional vehicle detector system functions.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
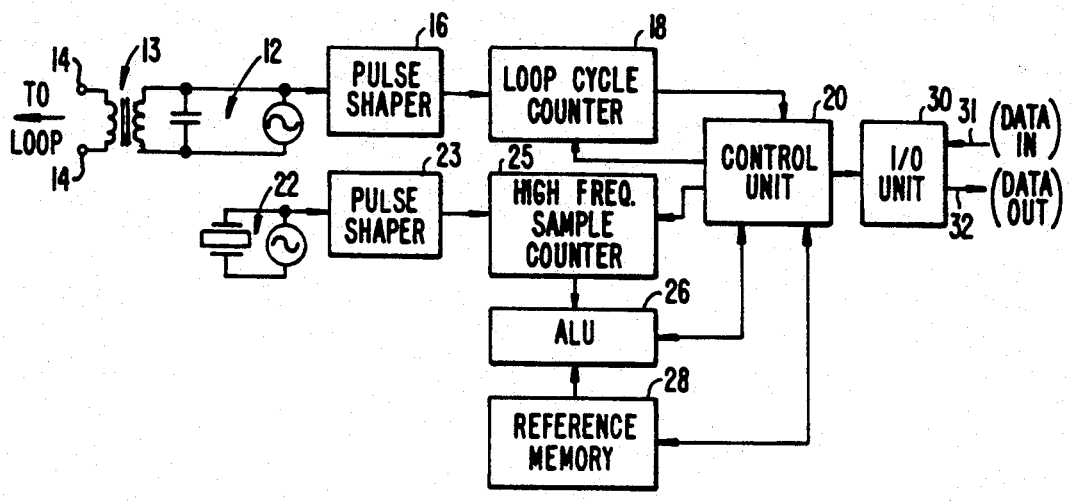
FIG. 1 is a block diagram illustrating a typical vehicle detector system.

Turning now to the drawings, FIG. 1 is an idealized block diagram of a conventional vehicle detector system incorporating the invention. As seen in this FIG., an oscillator 12 operable over a frequency range of about 20 Khz to about 80 Khz is coupled via a transformer 13 to a pair of output terminals 14. Output terminals 14 are adapted for connection to an inductive loop usually mounted within the roadbed in a position such that vehicles to be sensed will pass over the loop. Such loops are well known and are normally encountered in the United States of America in two popular sizes: a single multi-turn rectangular loop having approximate dimensions of 50 feet×6 feet, and a plurality (usually four) of multi-turn square having dimensions of approximately 6 feet×6 feet, the individual loops being connected in series, in parallel or in a combined series-parallel configuration. Loops of this type are normally found installed at controlled locations in the highway system, such as at intersections having signal heads controlled by a local intersection unit.

The oscillator circuit 12 is coupled via a squaring circuit 16 to a loop cycle counter 18. Loop cycle counter 18 typically comprises a multistage binary counter having a control input for receiving appropriate control signals from a control unit 20 and a status output terminal for providing appropriate status signals to the control unit 20, in the manner described below.

A second oscillator circuit 22, which typically generates a precise, crystal controlled relatively high frequency clock signal (e.g., a 12 Mhz clock signal) is coupled via a second squaring circuit 23 to a second binary counter 25. Counter 25 is typically a multi stage counter having a control input for receiving control signals from control unit 20 and a count state output for generating signals representative of the count state of counter 25 at any given time. The count state of counter 25 is coupled as one input to an arithmetic logic unit 26. The other input to arithmetic logic unit 26 is a reference value stored in a reference memory 28. Reference memory 28 is controlled by appropriate signals from control unit 20 in the manner described below.

An input/output unit 30 is coupled between the control unit 20 and externally associated circuitry. I/O unit 30 provides appropriate control signals via an upper input path 31 to specify the control parameters for the vehicle detector unit of FIG. 1, such as mode (i.e., call signal generation or vehicle count signal generation), sensitivity, and any special features desired. I/O unit 30 furnishes data output signals via lower path 32, the data output signals typically comprising signals indicating the presence or departure of a vehicle from the vicinity of the associated loop (when in the call signal generation mode) or the generation of a vehicle count signal (when in the counting mode).

Initially, control unit 20 supplies control signals to loop cycle counter which define the length of a sample period for the high frequency counting circuit comprising elements 22, 23 and 25. For example, if control unit 20 specifies a sample period of six loop cycles, loop cycle counter 18 is set to a value of 6 and, when the sample period is to commence, control until 20 permits loop cycle counter 18 to begin counting down from the value of 6 in response to the leading edge of each loop cycle signal furnished via shaping circuit 16 from loop oscillator circuit 12. Contemporaneously with the beginning of the countdown of the loop cycle counter 18, control unit 20 enables high frequency counter 25 to accumulate counts in response to the high frequency signals received from high frequency oscillator circuit 22 via second shaping circuit 23. At the end of the sample period (i.e., when the loop cycle counter 18 has been counted down to 0), control unit 20 generates a disable signal for the high frequency counter 25 to freeze the value accumulated therein during the sample period. Thereafter, this value is transferred to the ALU 26 and compared with the value stored in a reference memory 28, all under control of control unit 20. After the comparison has been made, the sample process is repeated.

For a conventional vehicle detector operation (specified by the mode signals on input path 31 to I/O unit 30), the reference value in reference memory 28 is a value representative of the inductance of the loop oscillator circuit comprising elements 12–14 (and the associated loop) at the end of the previous sample period. The reference is updated in a controlled manner at the end of each of comparison between the reference stored in memory 28 and the newly obtained sample from counter 25. The exact manner in which the reference in memory 28 is updated is more fully described in U.S. Pat. No. 5,028,921 for "Vehicle Detector Method and System, issued Jul. 2, 1991, the disclosure of which is hereby incorporated by reference. Whenever the difference between the current sample from counter 25 and the reference from memory 28 exceeds a first call threshold value, the control unit 20 senses this condition and causes the generation of an output signal on path 32 indicating the arrival of a vehicle within the loop vicinity. Similarly, when the difference between the current sample and the previous reference exceeds a second threshold in the No Call direction, control unit 20 senses this condition and causes the call output signal on path 32 to be dropped.

When the system of FIG. 1 is operated in the vehicle count mode according to the invention (which mode is specified by an appropriate mode signal on input path 31), the operation precedes in the following manner. Control unit 20 initiates the sample process to obtain a first reference value representative of the loop circuit inducted with no vehicle present in the loop. This first reference value, is stored in reference memory 28. Thereafter, successive samples are obtained and compared in ALU26 with the initial reference in reference memory 28. During this process, the initial reference is not updated in reference memory 28. So long as no car enters the associated loop, the reference will remain essentially unchanged. When a vehicle does enter the associated loop, the sample count in counter 25, which is representative of the inductance of the loop oscillator circuit, changes from the reference value stored in memory 28. Since the length of a sample period is relatively short compared to the speed with which the vehicle enters the vicinity of the loop, the change in the sample values successive stored in counter 25 is somewhat gradual with the values changing in an essentially monotonic fashion until the maximum effect of the vehicle on the loop inductance is achieved. Thereafter, the value of the samples begins to change in the opposite direction in an essentially monotonic fashion until the vehicle leaves the loop. The manner in which this variation in the sample values is employed according to the invention to generate vehicle count signals can best be understood by reference to specific examples.

Figure 2:
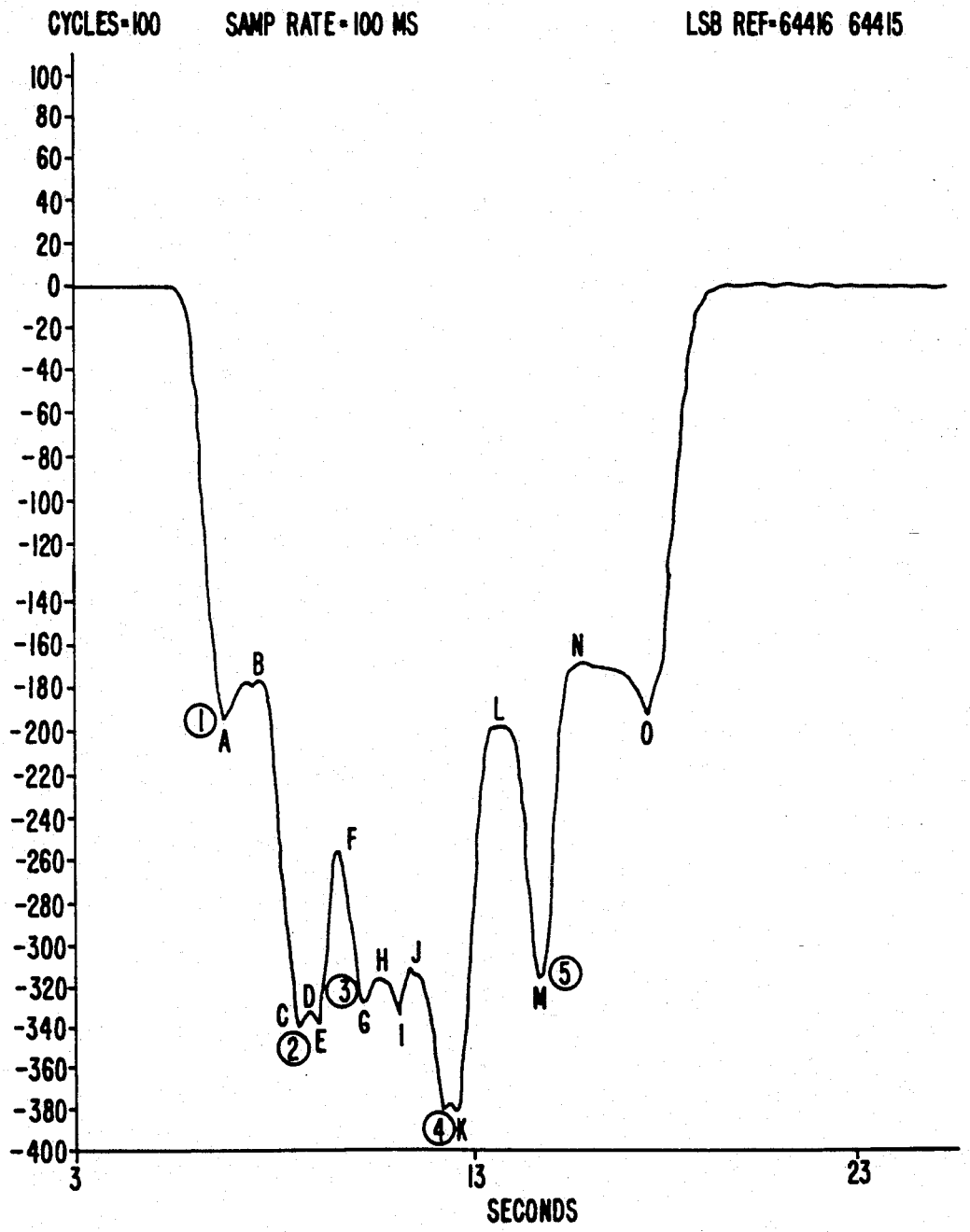
FIG. 2 is a chart illustrating the variation of the sample counts with vehicles entering a single loop.

With reference to FIG. 2, this Figure shows the manner in which the inductance of the loop oscillator circuit varies when five vehicles successively cross a standard rectangular 50 feet×6 feet loop. In FIG. 2, the ordinate represents the difference between the initial reference value (with no vehicle in the loop) and the successive sample values accumulated in counter 25, using a sample rate of approximately one sample per 100 milliseconds. The abscissa of FIG. 2 is timed in seconds. As seen in this Fig., initially the difference between the value stored in the reference memory 28 and the counter 25 is 0, corresponding to no vehicle in the loop. When the first vehicle begins to enter the loop, the difference between the reference value and each successive sample begins to change in the negative direction until the maximum effect is obtained at the inflection point labelled A. The reason why the difference has a negative value is due to the fact that the period of the loop oscillator signal decreases as the vehicle effect on the loop circuit inductance increases. Since the period of the loop oscillator signal decreases, the length of the sample period is correspondingly decreased (since the sample period is defined by an integral number of loop signals). Once the maximum inductive effect of the vehicle is reached at point A, the difference value plotted in FIG. 2 reverses direction as shown until a second inflection B point is reached. Thereafter, the change in values again reverses direction until inflection point C is reached. This point corresponds to the maximum inductive effect of the combination of the first and second vehicles detected in the loop. Beyond point C there is a reversal in direction of very short duration ending at D, followed by still another reversal until inflection point E is reached. After inflection point E the direction reverses until point F is reached. Beyond point F, direction again reverses until inflection point G. As will now be apparent, the progression of the five vehicles through the loop cannot be simply and readily detected by simply counting the inflection points resulting from the plotting of the difference values between the initial reference in memory 28 and the successive samples from counter 25. This is due to the complex interaction of the vehicles on the inductance of the loop circuit, as well as environmental and noise factors which affect the frequency of the loop oscillator circuit as well.

Even though the relationship between the inflection points in the plot of FIG. 2 and the vehicles entering the vicinity of the loop is complex, an accurate estimate of the numbered vehicles associated to a plot such as that shown in FIG. 2 can be obtained according to the invention. The estimate is obtained as follows. Once the first inflection point (point A) occurs, the control unit 20 and the ALU 26 calculates a threshold value termed the vehicle count threshold value, and this value is stored in memory 28. A threshold value of 12.5% of the difference value at point A (i.e., the value of the difference between the reference and the sample obtained for point A) has been found to be effective. Once the vehicle count threshold value has been obtained and stored, control unit 20 and ALU 26 continuously monitor for the next inflection point (point B of FIG. 2). The difference value for that point is likewise stored in memory 28. Next, control unit 20 and ALU 26 monitor for the next inflection point (point C in FIG. 2). When this point is determined, a calculation is made to determine whether the difference between the point C difference value and a point D difference value exceeds the 12½% vehicle count threshold value stored in memory 28. If so, inflection point C is determined to correspond to a vehicle entering the vicinity of the loop. At the next inflection point (point D) the difference value is again noted and stored in memory 28 and compared with the difference value at the next inflection point (point E). Since this difference does not exceed the 12½% vehicle count threshold value, point E is determined to not correspond to a vehicle entering the vicinity of the loop. When inflection point F is reached, the difference value corresponding to this point is again stored in memory 28, and this value is compared with the difference value at point G. Since the magnitude of the difference between the difference value at point G and point F exceeds the 12½% vehicle count threshold value, point G is indicated to correspond to a vehicle entering the vicinity of the loop. This process continues for all inflection points and, as can be seen by inspection, points K and M are each determined to correspond to a vehicle entering the vicinity of the loop; while points I and O are determined not to correspond to a vehicle entering the loop. Eventually, there will be a lull in traffic and the value of the successive samples obtained in counter 25 will gradually approach the value of the initial reference. When this condition obtains, a new reference may be stored in memory 28, and the process just described repeated for the next platoon of vehicles crossing the loop.

Figure 4:
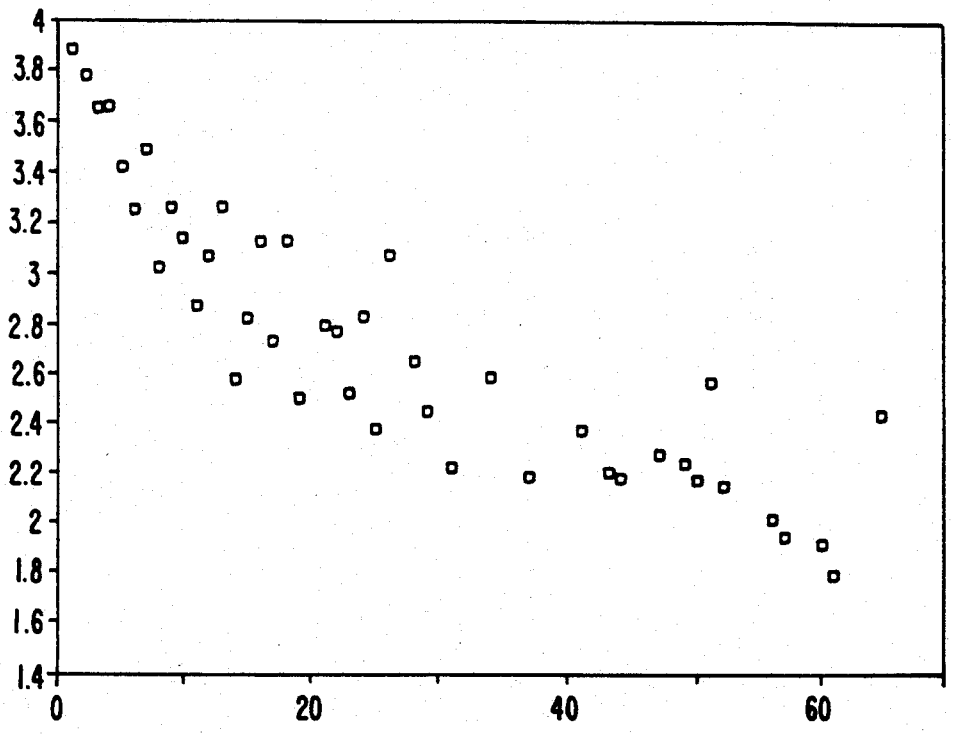
FIG. 4 is an interpolation chart between count events and true vehicle count.
Figure 3:
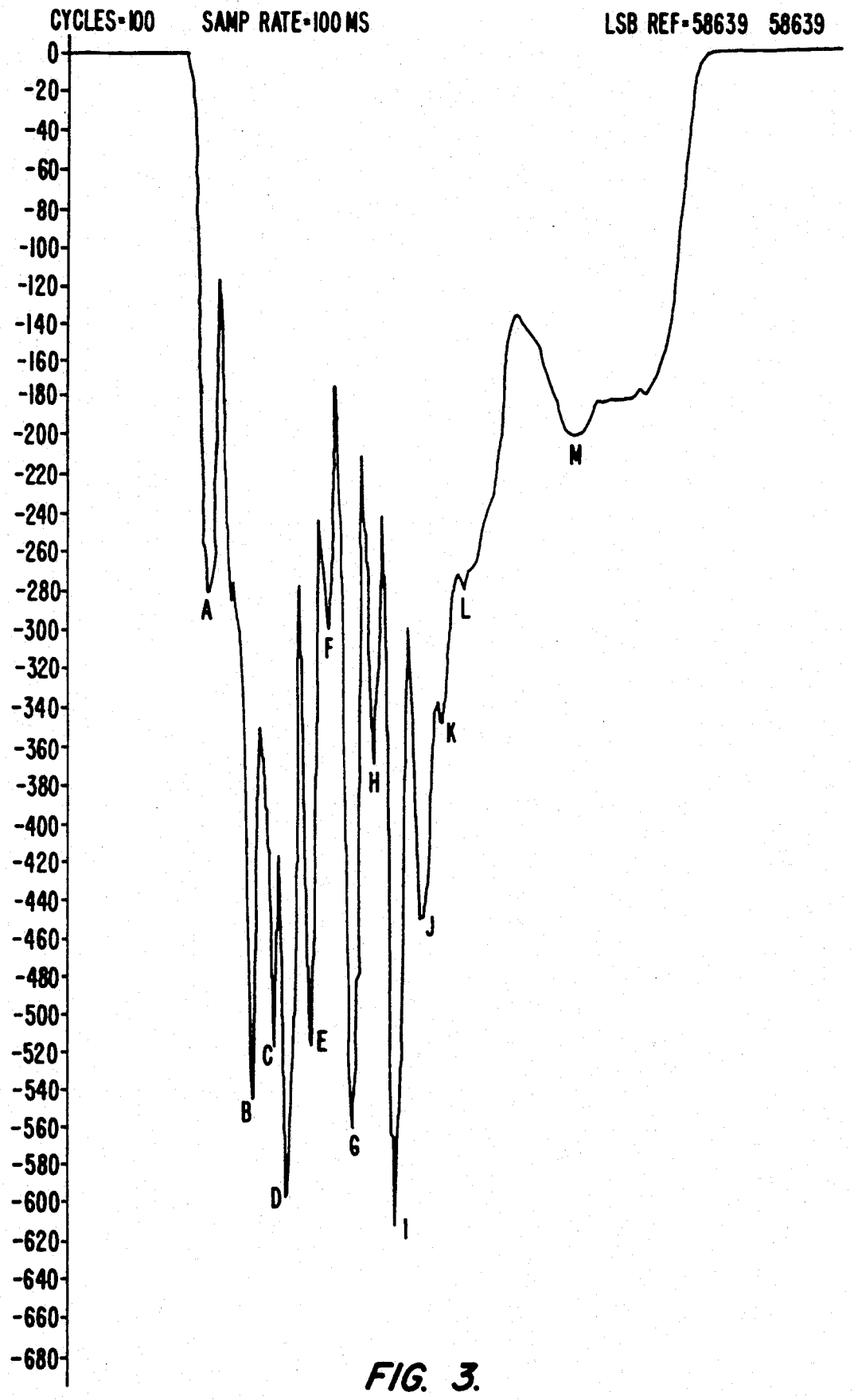
FIG. 3 is a chart similar to FIG. 2 illustrating the same effect for a four loop system.

FIG. 3 shows a more complicated plot obtained from five cars crossing four square standard loops connected in series and measuring 6 feet×6 feet. As seen in this Figure, the points corresponding to vehicle counts are labelled with the letters A–M. However, the pattern cannot be directly interpreted as with the FIG. 2 pattern by a simple one-to-one correspondence between those inflection points exceeding the 12½% vehicle count threshold value. Rather, it has empirically determined that interpolation is required in order to obtain an accurate estimate of the number of vehicles crossing the compound loop configuration of four loops connected in series. For the system whose results are depicted in FIG. 3, the interpolation factors were empirically obtained by independently counting vehicles crossing the compound loop installation and comparing this number with the number of inflection points exceeding the vehicle count threshold criterion. The result of this empirical determination is listed in Table A of this specification and is plotted in FIG. 4 in which the absicissa represents the number of cars crossing the compound loop installation over a measurement period of 15 minutes and the ordinate represents the division factor to be applied to the total number of inflection points which exceed the vehicle count threshold value. As an example, in FIG. 3 there are 13 peaks identified with the letters A–M, which, from Table A correspond to an absolute number of four. Even though the value for this example is off by 20% (since the actual number of vehicles crossing the loop installation was determined independently to be five), it has been found that statistically the accuracy of the invention is at least as precise as the visual observation method and the road tube method and, in many cases, substantially more accurate. From actual field data obtained, it appears that the upper limit of the accuracy of the invention is approximately 99%

In a given system, Table A is stored in memory 28 (or elsewhere in the system) as a look-up table. In operation, once a lull in count activity is determined (by an absence of any further inflection points for a threshold period of time such as one second), the control unit 20 performs a table look up using the accumulated number of qualified inflection points and generates a corresponding output signal which appears on path 32 and which indicates the number of vehicles crossing the loop installation. If desired, of course, the actual raw inflection point data itself may be simply output on path 32 to a follow-on computer in order to perform the statistical interpolation.

Although a single Table A is listed corresponding to a four loop configuration as described above, other tables can be prepared and stored corresponding to other loop configurations, such as square or rectangular loops connected in series, four square loops connected in parallel, three loops connected in series-parallel, etc. Any such table can be compiled in the same manner as that employed to obtain Table A: viz., setting up a pilot installation and independently counting the actual number of vehicles crossing the loop installation per selected unit time basis (e.g., 15 minutes), and constructing a look-up table corresponding to the collected data. In an installation having a plurality of such tables, it is necessary to specify which loop configuration the vehicle detector system shown in FIG. 1 will be attached to via loop terminals 14. This can be done by means of a multi-position switch, an input parameter keyboard, removable jumpers or diodes, or any other suitable technique for supplying parametric input data on path 31 indicating the nature of the loop configuration.

Figures 5, 5A, 5B:
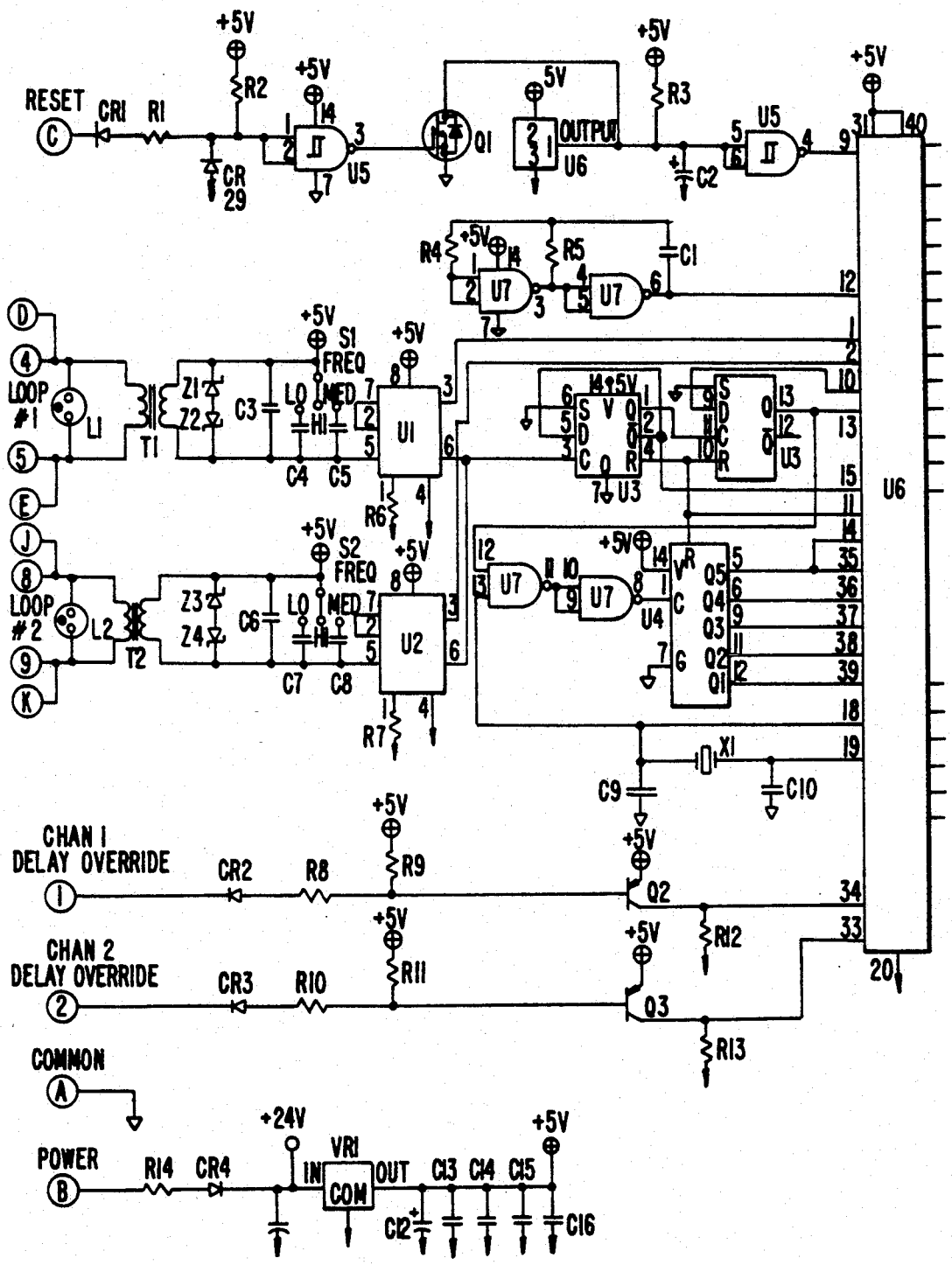
FIG. 5 is a diagram illustrating the relationship between FIGS. 5*a* and 5*b*.
FIGS. 5*a* and 5*b* are schematic diagrams of a vehicle detector system incorporating the invention.
Figure 5B:
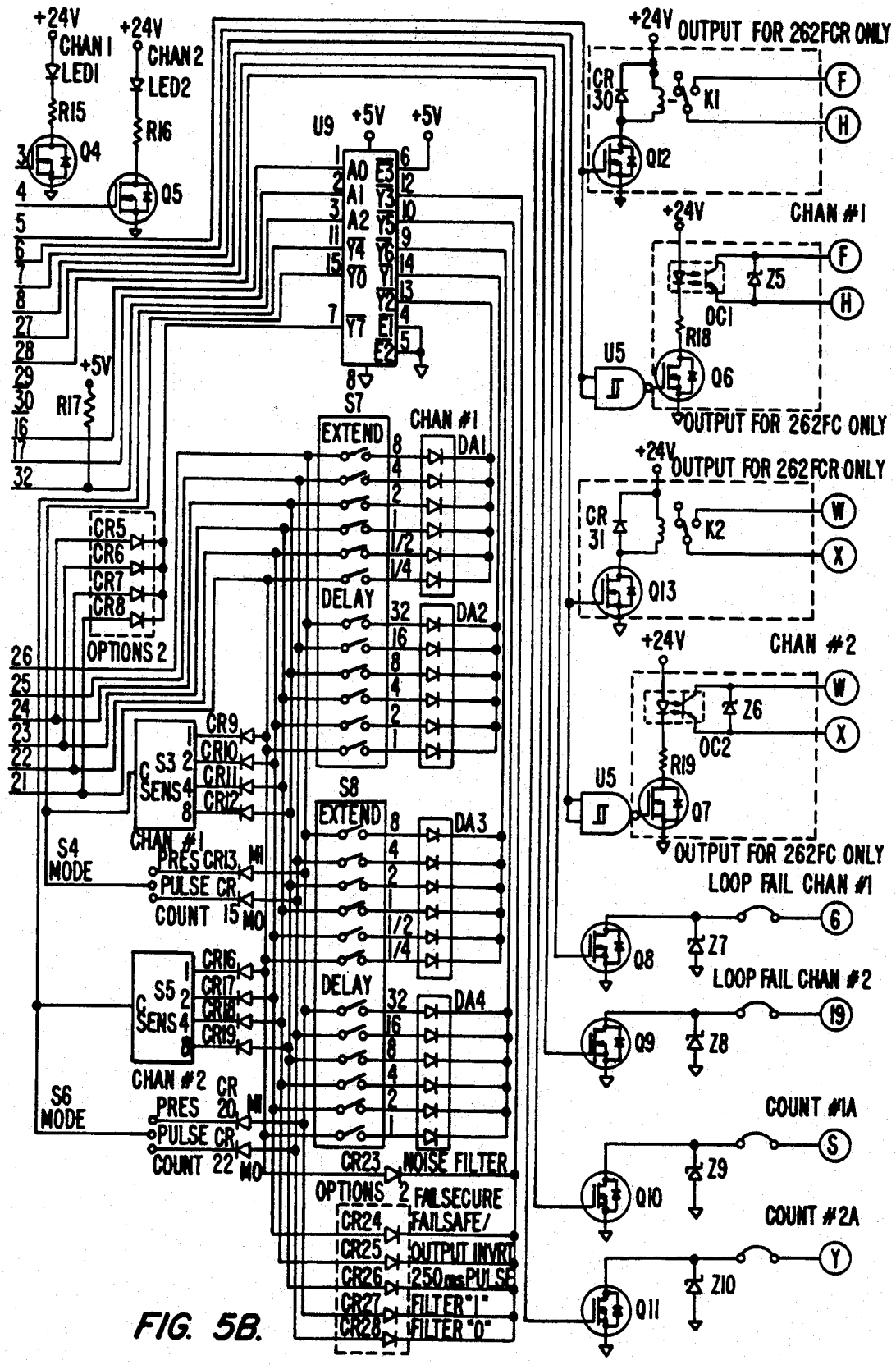

FIG. 5 illustrates a specific embodiment of a two channel vehicle detector system incorporating the vehicle count invention described above. The system shown in FIG. 5 includes a pair of mode switches designated S4 mode (channel 1) and S6 mode (channel 2), each switch having a count position. To select between a standard rectangular long loop and an alternate configuration of four 6 feet×6 feet square loops, the embodiment of FIG. 5 employs a diode designated CR5. For the rectangular loop, the diode is removed; while for the four loop configuration the diode is present. An ASCII hex listing of the software used for vehicle counting with the system of FIG. 5 is attached as Appendix I.

While the above provides a full and complete disclosure of the preferred embodiments of the invention various modifications, alternate constructions and equivalents may be employed. For example, although the system is illustrated in FIG. 1 using discrete logic blocks, microprocessor based versions (such as that illustrated in FIG. 5) may be employed. Further, when establishing the initial reference value against which the first major inflection point is to be measured, it may be desirable to average these values over successive long counting periods (i.e., several groups of active periods) in order to average out fluctuations in the inductive effect due to different sized vehicles and environmental conditions). Therefore, the above should not be construed as limiting the invention, which is defined by the appended claims.

APPENDIX I

```
:100BFB0022E55B7009755B06E54C6003C259222048
:100C0B005B03020CCE205A03020CB2C3E5609517AE
:100C1B00E5619518E56295194003020CA82059323D
:100C2B0085115D85125E85135FC3E5119560FEE549
:100C3B00129561FDB12FB12FB12FE563456470049F
:100C4B008E638D64E5632EFEE5643DFDB12F8E63EF
:100C5B008D64C25AE5602563FEE5613564FDE5628E
:100C6B003400FCC3EE955DED955EEC955F502CE585
:100C7B002954C0701BE52730E30330591E055AE594
:100C8B002920E117E52420E31230E70F0559800BEB
:100C9B00055CE55C7005055C755A66D25985176075
:100CAB0085186185196222C3E5179560E518956172
:100CBB00E519956250E7D25A85605D85615E856264
:100CCB005F80DAC259D25AE52954C06052E55C60A4
:100CDB004E900D9AE52954C02323146009900D689A
:100CEB00146003900D37E55C93F8C3E55C943140D9
:100CFB0017E55C75F0058423F8E5F0600B146008CC
:100D0B00081460041460010 8C2AFE8255AF55AD2E2
:100D1B00AFE52430E709C2AFE82559F559D2AF75D5
:100D2B005C0081A8C3ED13FDEE13FE220000010150
```

TABLE A

| | | | | | |
|---|---|---|---|---|---|
| 0 = 0 | 43 = 17 | 86 = 34 | 129 = 52 | 172 = 69 | 215 = 86 |
| 1 = 0 | 44 = 17 | 87 = 35 | 130 = 52 | 173 = 69 | 216 = 86 |
| 2 = 1 | 45 = 18 | 88 = 35 | 131 = 52 | 174 = 70 | 217 = 87 |
| 3 = 1 | 46 = 18 | 89 = 36 | 132 = 53 | 175 = 70 | 218 = 87 |
| 4 = 1 | 47 = 19 | 90 = 36 | 133 = 53 | 176 = 70 | 219 = 88 |
| 5 = 1 | 48 = 19 | 91 = 36 | 134 = 54 | 177 = 71 | 220 = 88 |
| 6 = 1 | 49 = 20 | 92 = 37 | 135 = 54 | 178 = 71 | 221 = 88 |
| 7 = 2 | 50 = 20 | 93 = 37 | 136 = 54 | 179 = 72 | 222 = 89 |
| 8 = 2 | 51 = 20 | 94 = 38 | 137 = 55 | 180 = 72 | 223 = 89 |
| 9 = 2 | 52 = 21 | 95 = 38 | 138 = 55 | 181 = 72 | 224 = 90 |
| 10 = 3 | 53 = 21 | 96 = 38 | 139 = 56 | 182 = 73 | 225 = 90 |
| 11 = 3 | 54 = 22 | 97 = 39 | 140 = 56 | 183 = 73 | 226 = 90 |
| 12 = 3 | 55 = 22 | 98 = 39 | 141 = 56 | 184 = 74 | 227 = 91 |
| 13 = 4 | 56 = 22 | 99 = 40 | 142 = 57 | 185 = 74 | 228 = 91 |
| 14 = 4 | 57 = 23 | 100 = 40 | 143 = 57 | 186 = 74 | 229 = 92 |
| 15 = 5 | 58 = 23 | 101 = 40 | 144 = 58 | 187 = 75 | 230 = 92 |
| 16 = 5 | 59 = 24 | 102 = 41 | 145 = 58 | 188 = 75 | 231 = 92 |
| 17 = 6 | 60 = 24 | 103 = 41 | 146 = 58 | 189 = 76 | 232 = 93 |
| 18 = 6 | 61 = 24 | 104 = 42 | 147 = 59 | 190 = 76 | 233 = 93 |
| 19 = 7 | 62 = 25 | 105 = 42 | 148 = 59 | 191 = 76 | 234 = 94 |
| 20 = 7 | 63 = 25 | 106 = 42 | 149 = 60 | 192 = 77 | 235 = 94 |
| 21 = 7 | 64 = 26 | 107 = 43 | 150 = 60 | 193 = 77 | 236 = 94 |
| 22 = 8 | 65 = 26 | 108 = 43 | 151 = 60 | 194 = 78 | 237 = 95 |
| 23 = 8 | 66 = 26 | 109 = 44 | 152 = 61 | 195 = 78 | 238 = 95 |
| 24 = 9 | 67 = 27 | 110 = 44 | 153 = 61 | 196 = 78 | 239 = 96 |
| 25 = 9 | 68 = 27 | 111 = 44 | 154 = 62 | 197 = 79 | 240 = 96 |
| 26 = 9 | 69 = 28 | 112 = 45 | 155 = 62 | 198 = 79 | 241 = 96 |
| 27 = 10 | 70 = 28 | 113 = 45 | 156 = 62 | 199 = 80 | 242 = 97 |
| 28 = 10 | 71 = 28 | 114 = 46 | 157 = 63 | 200 = 80 | 243 = 97 |
| 29 = 11 | 72 = 29 | 115 = 46 | 158 = 63 | 201 = 80 | 244 = 98 |
| 30 = 11 | 73 = 29 | 116 = 46 | 159 = 64 | 202 = 81 | 245 = 98 |
| 31 = 12 | 74 = 30 | 117 = 47 | 160 = 64 | 203 = 81 | 246 = 98 |
| 32 = 12 | 75 = 30 | 118 = 47 | 161 = 64 | 204 = 82 | 247 = 99 |
| 33 = 13 | 76 = 30 | 119 = 48 | 162 = 65 | 205 = 82 | 248 = 99 |
| 34 = 13 | 77 = 31 | 120 = 48 | 163 = 65 | 206 = 82 | 249 = 100 |
| 35 = 13 | 78 = 31 | 121 = 48 | 164 = 66 | 207 = 83 | 250 = 100 |
| 36 = 13 | 79 = 32 | 122 = 49 | 165 = 66 | 208 = 83 | 251 = 100 |
| 37 = 14 | 80 = 32 | 123 = 49 | 166 = 66 | 209 = 84 | 252 = 101 |
| 38 = 14 | 81 = 32 | 124 = 50 | 167 = 67 | 210 = 84 | 253 = 101 |
| 39 = 15 | 82 = 33 | 125 = 50 | 168 = 67 | 211 = 84 | 254 = 102 |
| 40 = 15 | 83 = 33 | 126 = 50 | 169 = 68 | 212 = 85 | 255 = 102 |
| 41 = 16 | 84 = 34 | 127 = 51 | 170 = 68 | 213 = 85 | |
| 42 = 16 | 85 = 34 | 128 = 51 | 171 = 68 | 214 = 86 | |

What is claimed is:

1. A method of estimating the number of vehicles crossing a loop inductor, said method comprising the steps of:

(a) producing a measuring signal having a succession of values representative of loop inductance referenced to an initial value;

(b) determining a first inflection point of the measuring signal;

(c) establishing a vehicle count threshold value from the value of the measuring signal at the first inflection point;

(d) determining a vehicle count event from the threshold value and the value of the measuring signal at subsequent points of the measuring signal; and (e) producing a vehicle count estimate from the total number of vehicle count events determined in step (d).

2. The method of claim 1 wherein said step (a) includes the steps (i) of producing each value of the measuring signal by accumulating a pulse count over a sample interval and (ii) comparing each value from step (i) with an initial reference count representative of the loop inductance with no vehicle present.

3. The method of claim 1 wherein said step (b) is performed by comparing successive values of the measuring signal and determining a reversal in the direction of change in successive values.

4. The method of claim 1 wherein said step (c) is performed by computing a percentage of the difference between the value of the measuring signal at the first inflection point and the initial value.

5. The method of claim 1 wherein said step (d) is performed by (i) determining a subsequent inflection point, (ii) comparing the value of the measuring signal at the subsequent inflection point and points succeeding the second inflection point, and (iii) denoting a vehicle count even when the difference between the value of the measuring signal at the subsequent inflection point and a succeeding point exceeds the vehicle count threshold value before another inflection point is determined.

6. The method of claim 5 wherein said step (d) is repeated for a predetermined time period substantially longer than the time required to perform the sequence of steps (i)-(iii).

7. The method of claim 1 wherein said step (e) is performed by computing a vehicle count estimate by dividing the number of vehicle count events by a factor lying in the range from 1 to N, where N is the total number of individual loops comprising the loop inductor.

8. The method of claim 1 wherein said steps (a)-(e) are repeated, and wherein said method further includes the step of producing an initial value averaged over the number of repetitions of steps (a)-(e).

9. A system for detecting the arrival and departure of vehicles at a location having a loop inductor, said system comprising:

vehicle sensing means for producing a measuring signal having a succession of values representative of loop inductance referenced to an initial value;

means for specifying predetermined vehicle call signal criteria;

means for specifying predetermined vehicle count signal criteria;

mode selector means for specifying a vehicle detector mode and a vehicle count mode;

means for generating vehicle call signals in response to values of said measuring signal meeting the predetermined call signal criteria when the mode selector means specifies the vehicle detector mode; and means for generating vehicle count signals in response to values of said measuring signal meeting predetermined vehicle count signal criteria when the mode selector means specifies the vehicle detector mode.

10. The invention of claim 9 wherein said system further includes loop configuration specifying means for establishing said predetermined vehicle count signal criteria for a given type of loop inductor.

11. The invention of claim 9 wherein said vehicle count signal generating means includes means for determining a first inflection point of the measuring signal, means for establishing a vehicle count threshold value from the measuring signal value at the first inflection point, means for determining a vehicle count event from the threshold value and the value of the measuring signal at subsequent points of the measuring signal, and means for producing a vehicle count estimate from the total number of vehicle count events.

12. The invention of claim 11 wherein said vehicle sensing means includes means for establishing a sample interval, means for generating a pulse train, means for acculating a pulse count from said pulse train over said sample interval, and means for comparing the accumulated pulse count with an initial reference count representative of the loop inductance with no vehicle present.

13. The invention of claim 11 wherein said inflection point determining means includes means for comparing successive values of the measuring signal and means for determining a reversal in the direction of change in successive values.

14. The invention of claim 11 wherein said vehicle count threshold value establishing means includes means for computing a percentage of the difference between the value of the measuring signal at the first inflection point and the initial value.

15. The invention of claim 11 wherein said vehicle count event determining means includes means for determining a subsequent inflection point, means for comparing the value of the measuring signal at points succeeding the second inflection point and the value of the measuring signal at the second inflection point, and means for denoting a vehicle count event when the difference between the value of the measuring signal at the second inflection point and a succeeding point exceeds the vehicle count threshold value before another inflection point is determined.

16. The invention of claim 15 wherein said vehicle count signal generating means further includes means for enabling said subsequent inflection point determining means, said comparing means and said vehicle count event denoting means for a predetermined time period substantially greater than the duration of the sample interval.

17. The invention of claim 11 wherein said vehicle count estimate producing means includes means for computing a vehicle count estimate by dividing the number of vechicle count events by a factor lying in the range for 1 to N, where N is the total number of individual loops comprising the loop inductor.

18. The invention of claim 11 wherein said vehicle count signal generating means includes means for producing an initial value representative of the loop inductance with no vehicle present averaged over a plurality of platoons of vehicles.

19. The invention of claim 11 wherein said vehicle count signal generating means further includes means for producing a vehicle count threshold value averaged over a plurality of platoons of vehicles.

* * * * *